US007871750B2

(12) United States Patent
Moriyama

(10) Patent No.: US 7,871,750 B2
(45) Date of Patent: Jan. 18, 2011

(54) PROCESS FOR PREPARING MIXED COLOR TONER

(75) Inventor: Shinji Moriyama, Wakayama (JP)

(73) Assignee: Kao Corporation, Tokyo (JP)

( * ) Notice: Subject to any disclaimer, the term of this patent is extended or adjusted under 35 U.S.C. 154(b) by 399 days.

(21) Appl. No.: 11/954,839

(22) Filed: Dec. 12, 2007

(65) Prior Publication Data

US 2008/0292984 A1 Nov. 27, 2008

(30) Foreign Application Priority Data

Dec. 20, 2006 (JP) ..... 2006-343220
Nov. 30, 2007 (JP) ..... 2007-310997

(51) Int. Cl.
*G03G 9/16* (2006.01)

(52) U.S. Cl. ..... 430/137.21; 430/137.1

(58) Field of Classification Search ..... 430/137.21, 430/137.1

See application file for complete search history.

(56) References Cited

U.S. PATENT DOCUMENTS 5,229,188 A * 7/1993 Takeuchi et al. ..... 428/195.1
5,415,963 A * 5/1995 Toya et al. ..... 430/107.1
5,840,456 A * 11/1998 Tomita et al. ..... 430/109.1
5,866,286 A 2/1999 Christy et al.
5,899,605 A * 5/1999 Caruthers et al. ..... 399/223
5,935,751 A * 8/1999 Matsuoka et al. ..... 430/108.8
6,326,115 B1 12/2001 Nakanishi et al.
6,641,965 B2 * 11/2003 Nakamura et al. ..... 430/107.1
6,828,072 B1 12/2004 Yamazaki et al.
6,996,358 B2 * 2/2006 Ayaki et al. ..... 430/45.4
2004/0137349 A1 7/2004 Horikoshi et al.
2008/0261142 A1 * 10/2008 Kittle et al. ..... 430/111.4

FOREIGN PATENT DOCUMENTS

JP 6-348101 12/1994
JP 8-20636 1/1996
JP 10-239903 9/1998
JP 11-133668 5/1999
JP 2004-133246 4/2004
JP 2004-516494 6/2004
JP 2005-316124 11/2005
WO 2007006780 * 1/2007

* cited by examiner

*Primary Examiner*—Hoa V Le
(74) *Attorney, Agent, or Firm*—Oblon, Spivak, McClelland, Maier & Neustadt, L.L.P.

(57) ABSTRACT

A process for preparing a mixed color toner obtained by mixing two or more kinds of color toners of which each color is different, including the following steps (1) and (2):

(1) determining zeta potential distributions of each of the color toners, and (2) mixing the color toners in combination so that an overlapping ratio of the zeta potential distributions is 70.0% or more;

a mixed color toner obtainable by the process; a two-component developer containing the toner; and a method of forming fixed images using the toner. The mixed color toner obtainable by the present invention is used for, for example, developing a latent image formed in electrophotography, electrostatic recording method, electrostatic printing method, or the like.

5 Claims, No Drawings

PROCESS FOR PREPARING MIXED COLOR TONER

FIELD OF THE INVENTION

The present invention relates to a mixed color toner used for, for example, developing a latent image formed in electrophotography, electrostatic recording method, electrostatic printing method, or the like, and a process for preparing the mixed color toner; a two-component developer containing the toner; and a method of forming fixed images using the toner.

BACKGROUND OF THE INVENTION

For the purpose of manufacturing a toner of a custom color that can meet the diverse needs of users, and two-colors printing or the like that can simplify an apparatus, various techniques for mixing two or more kinds of toners of which each color is different have been explored (see JP-A-Hei-6-348101, JP2004-133246 A, JP2005-316124 A, JP2004-516494 A, and the like).

SUMMARY OF THE INVENTION

The present invention relates to:

[1] a process for preparing a mixed color toner obtained by mixing two or more kinds of color toners of which each color is different, including following steps (1) and (2):

(1) determining zeta potential distributions of each of the color toners, and (2) mixing the color toners in combination so that an overlapping ratio of the zeta potential distributions is 70.0% or more;

[2] a mixed color toner obtainable by the process as defined in the above item [1];

[3] a two-component developer containing the mixed color toner as defined in the above item [2] and a carrier; and

[4] a method of forming fixed images, including the step of developing the mixed color toner according to a non-contact development system.

DETAILED DESCRIPTION OF THE INVENTION

However, even if each color of color toners is prepared from the same composition according to the same method, and a toner that has been adjusted to a desired color by mixing those color toners is used, toner dusts (toner scattering) are generated in continuous printing, and the fixed images undergo changes in color.

The present invention relates to a mixed color toner obtained by mixing two or more kinds of color toners of which each color is different, which can maintain color of the fixed images constant also in continuous printing, and a process for preparing the mixed color toner; a two-component developer containing the toner; and a method of forming fixed images using the toner.

According to the present invention, color of the fixed images can be held constant also in continuous printing using a mixed color toner obtainable by mixing two or more kinds of color toners of which each color is different.

These and other advantages of the present invention will be apparent from the following description.

As a result of studies on the cause of toner dusts, the present inventors have found that toner dusts are related to a zeta potential distribution of a color toner. The present invention has been accomplished thereby.

In other words, toner dusts are affected by charging property of a toner, and upon studying charging property of a toner, it has been conventionally necessary to consider a charge-giving member such as, for example, a charging blade in one-component development system, and for example, a carrier in two-component development system. However, it is essentially necessary to consider charging property itself originally owned by the toner which is not affected by the charge-giving member. The present inventors have found that the charging property is related to a zeta potential distribution of the color toner.

One of the significant features of the present invention resides in that, upon preparing a mixed color toner by mixing two or more kinds of color toners of which each color is different, remarking on chargeability of each of the color toners, a zeta potential distribution is used as an index of chargeability. Charges of the toner determined according to a general method, are determined by triboelectric charging with a charge-generating material such as a carrier, and greatly affected by the charge-generating material. While on the other hand, in the present invention, a zeta potential distribution is determined as an index of charging property that the toner itself has, and the color toners of which an overlap of the zeta potential distributions is large are mixed, whereby a mixed color toner that the color change of the fixed images due to toner dusts is prevented, even subjecting to continuous printing, is obtained. In the present invention, there can be properly selected each color of color toners which are subjected to mixing upon preparation of a mixed color toner, in other words, original color toners or primary color toners, itself, depending on an aimed color of a mixed color toner. Concretely, the color toners contain red toners, green toners, blue toners, yellow toners, magenta toners, and cyan toners, as well as black toners and transparent toners.

A process for preparing a mixed color toner obtained by mixing two or more kinds of color toners of which each color is different of the present invention includes the following steps (1) and (2):

(1) determining zeta potential distributions of each of the color toners; and (2) mixing the color toners in combination so that an overlapping ratio of the zeta potential distributions is 70.0% or more, preferably 73% or more, and more preferably 75% or more.

The zeta potential distributions of the toner determined in the step (1) refer to zeta potential distributions of individual toner particles contained in the toner. The zeta potential distribution is obtained by determining zeta potentials of any toner particles contained in each of the color toner, for such the number of the toner particles that a certain stable zeta potential distribution is obtainable, for example, from 50 to 200 particles of the toner particles, according to the method described in Examples set forth below. Conventionally, a zeta potential of the whole toner particles has been determined as a zeta potential of the toner. However, in the present invention, zeta potentials of individual toner particles contained in each of the color toners are determined. The zeta potentials of the individual toner particles are determined, whereby the zeta potential distributions of the toner particles in each of the color toners can be revealed.

An overlapping ratio of the zeta potential distributions in the above-mentioned step (2) refers to a degree of an overlap of the zeta potential distributions of each of the color toners determined in the step (1). In the present invention, the overlapping ratio of the zeta potential distributions is expressed in a value that, in a histogram of the zeta potential distribution prepared with zeta potential intervals of 5 mV, the total number of toner particles of which segments of zeta potential correspond among the color toners is divided by the number of all the toner particles determined, and expressed in percentage. Upon mixing three or more kinds of the color toners, it is preferable that the overlapping ratio of the whole color toners to be mixed is within the above-mentioned range, and also, it is more preferable that all the overlapping ratios between the color toners to be mixed are within the above-mentioned range (in other words, the overlapping ratios between the color toners in combinations of every two kinds of the color toners are within the above-mentioned range).

Zeta potentials of toner particles of 70% by number or more, and preferably 80% by number or more of the toner particles constituting each of the color toners are preferably more than 15 mV and 80 mV or less by the absolute value, more preferably more than 20 mV and 75 mV or less, and even more preferably more than 25 mV and 70 mV or less, from the viewpoint of reducing toner dusts.

The zeta potential of the toner particles can be determined according to the method described in Examples set forth below. A zeta potential can be adjusted, for example, by the kinds and amount of a charge control agent.

Each of the color toners in the present invention include a resin binder, a colorant, or the like that are ordinarily used.

The resin binder in the present invention includes polyesters, vinyl resins such as styrene-acrylic resins, epoxy resins, polycarbonates, polyurethanes, hybrid resins having two or more resin components, and the like. The polyester is preferable from the viewpoint of improving dispersibility of an additive in the toner to further improve homogenization of the zeta potential distribution, but not particularly limited thereto. Particularly, when a toner of the present invention contains a charge control agent having a carboxyl group, it is presumed that the charges on the toner surface are more evened due to synergism of a carboxyl group of the polyester and a carboxyl group of the charge control agent, so that the effect of the present invention is more remarkably exhibited. The polyester is contained in an amount of preferably from 50 to 100% by weight, more preferably from 70 to 100% by weight, and even more preferably substantially 100% by weight, of the resin binder.

The polyester uses a known alcohol component and a known carboxylic acid component such as a carboxylic acid, an anhydride thereof, or an ester thereof as the raw material monomers, and is obtained by polycondensation of these components.

The alcohol component includes alkylene (2 or 3 carbon atoms) oxide (average number of moles: 1 to 16) adducts of bisphenol A, such as polyoxypropylene(2.2)-2,2-bis(4-hydroxyphenyl)propane and polyoxyethylene(2.0)-2,2-bis(4-hydroxyphenyl)propane, ethylene glycol, propylene glycol, glycerol, pentaerythritol, trimethylolpropane, hydrogenated bisphenol A, sorbitol, or alkylene (2 to 4 carbon atoms) oxide (average number of moles: 1 to 16) adducts thereof, and the like.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as trimellitic acid and pyromellitic acid; acid anhydrides thereof, alkyl (1 to 3 carbon atoms) esters thereof, and the like. The above-mentioned acids, acid anhydrides and alkyl esters of these acids are collectively referred to herein as carboxylic acid compound.

Here, the alcohol component may properly contain a monohydric alcohol, and the carboxylic acid component may properly contain a monocarboxylic acid compound, from the viewpoint of adjusting the molecular weight and improving offset resistance.

The polyester is obtained by, for example, polycondensation of the alcohol component and the carboxylic acid component at a temperature of from 180° to 250° C. in an inert gas atmosphere, in the presence of an esterification catalyst as desired.

It is preferable that the polyester has a softening point of from 80° to 165° C., a glass transition temperature of from 50° to 85° C., and an acid value of from 0.5 to 60 mgKOH/g, from the viewpoint of durability and fixing ability.

Here, in the present invention, the polyester may be a polyester that has been modified to an extent that the polyester do not substantially impair the properties. As a modified polyester, a polyester that has been grafted or blocked with phenol, urethane, epoxy, or the like according to the method described in JP-A-Hei-11-133668, JP-A-Hei-10-239903, JP-A-Hei-8-20636, or the like is exemplified.

The charge control agent may be either a positively chargeable charge control agent or a negatively chargeable charge control agent, and also these may be used together.

The positively chargeable charge control agent includes Nigrosine dyes, quaternary ammonium salts, and the like. A quaternary ammonium salt is preferable from the viewpoint that an effect on color tone of the toner is small.

The quaternary ammonium salt of a carboxylic acid is preferably a compound represented by the formula (I):

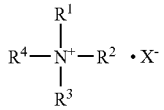

(I)

wherein each of $R^1$ to $R^4$, which may be identical or different, is a lower alkyl group having 1 to 8 carbon atoms which may be substituted by a halogen atom, an alkyl group or an alkenyl group having 8 to 22 carbon atoms, or an aryl group having 6 to 20 carbon atoms or an aralkyl group having 7 to 20 carbon atoms; and $X^-$ is a carboxylate ion.

In the present invention, from the viewpoint of giving a toner more stable charging property and more improved fixing ability, each of $R^1$ to $R^4$ is preferably a lower alkyl group having 1 to 4 carbon atoms which may be substituted by a halogen atom, an alkyl group having 12 to 18 carbon atoms, or a phenyl group and a benzyl group, and $X^-$ is preferably an aromatic carboxylate ion and an aliphatic carboxylate ion, and more preferably an aromatic carboxylate ion. The aromatic carboxylate ion includes a carboxylate ion having a benzoic acid backbone.

A carboxylic acid having a benzoic acid backbone includes benzoic acid, dithiodibenzoic acid, and the like.

Further, a more preferred quaternary ammonium salt of dithiodibenzoic acid includes a compound represented by the formula (Ia):

(Ia)

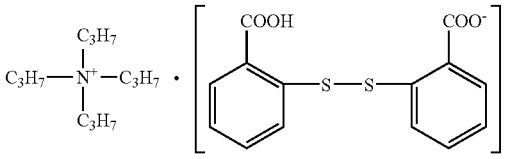

in the present invention.

Commercially available products containing the compound represented by the formula (Ia) include "COPY CHARGE PSY" (commercially available from Clariant (Japan) K.K.) and the like.

The negatively chargeable charge control agent includes metal-containing azo dyes, copper phthalocyanine dyes, metal complexes of a salicylic acid compound, and nitroimidazole derivatives. Among them, a metal complex of a salicylic acid compound is preferable, from the viewpoint of the effect of giving high chargeability.

The metal complex of a salicylic acid compound is preferably a metal complex of a salicylic acid compound represented by the formula (II):

(II)

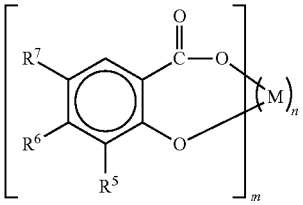

wherein each of $R^5$, $R^6$ and $R^7$ is independently a hydrogen atom, or a linear or a branched, alkyl group having 1 to 10 carbon atoms or alkenyl group having 2 to 10 carbon atoms; M is zinc, zirconium, chromium, aluminum, copper, nickel, or cobalt; m is an integer of 2 or more; and n is an integer of 1 or more.

In the formula (II), $R^6$ is preferably a hydrogen atom, and each of $R^5$ and $R^7$ is preferably a branched alkyl group, and more preferably a tert-butyl group.

M is preferably zinc or chromium which has high electronegativity and an excellent effect of giving chargeability, and more preferably chromium.

Commercially available products of chromium complexes of a salicylic acid compound which are suitably used in the present invention in which $R^6$ is a hydrogen atom, and each of $R^5$ and $R^7$ is a tert-butyl group include "BONTRON E-81" (commercially available from Orient Chemical Co., Ltd.) and the like, and commercially available products of zinc complexes of a salicylic acid compound which are suitably used in the present invention in which $R^6$ is a hydrogen atom, and each of $R^5$ and $R^7$ is a tert-butyl group include "BONTRON E-84" (commercially available from Orient Chemical Co., Ltd.) and the like.

The content of the charge control agent varies also depending upon the kinds of the charge control agent or the like. The charge control agent is contained in an amount of preferably from 0.1 to 10 parts by weight, based on 100 parts by weight of the resin binder. For example, in the case of the quaternary ammonium salt, it is contained in an amount of preferably from 0.1 to 5 parts by weight, and more preferably from 0.3 to 3 parts by weight, based on 100 parts by weight of the resin binder. In addition, in the case of the metal complex of a salicylic acid compound, it is contained in an amount of preferably from 0.1 to 10 parts by weight, and more preferably from 0.5 to 7 parts by weight, based on 100 parts by weight of the resin binder. When the quaternary ammonium salt and the metal complex of a salicylic acid compound are used together, in a case where positive chargeability is given to a toner, a weight ratio of the quaternary ammonium salt and the metal complex of a salicylic acid compound, i.e., metal complex of a salicylic acid compound/quaternary ammonium salt, is preferably from 1/10 to 1/3, and more preferably from 1/8 to 1/5, from the viewpoint of giving appropriate chargeability to a toner. In a case where negative chargeability is given to a toner, a weight ratio of the quaternary ammonium salt and the metal complex of a salicylic acid compound, i.e., quaternary ammonium salt/metal complex of a salicylic acid compound, is preferably from 1/8 to 1/2, and more preferably from 1/6 to 1/3, from the same viewpoint.

Chargeability of the toner of the present invention is not particularly limited to, and a negatively chargeable toner is preferable since it is preferable to use polyester as a resin binder.

Further, the toner of the present invention may properly contain an additive such as a colorant, a releasing agent, an electric conductivity modifier, an extender, a reinforcing filler such as a fibrous substance, an antioxidant, an anti-aging agent, or a magnetic material.

As the colorant, a dye, a pigment, or the like which is used as a colorant for a toner can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, Isoindoline, Disazoyellow, and the like. These colorants can be used alone or in admixture of two or more kinds. The colorant is contained in an amount of preferably from 1 to 40 parts by weight, and more preferably from 3 to 10 parts by weight, based on 100 parts by weight of the resin binder.

Each of the color toners is preferably a pulverized toner, and obtained by, for example, mixing a resin binder, a colorant, or the like, with a mixer such as a Henschel mixer or a ball-mill, thereafter melt-kneading with a closed kneader, a single-screw or twin-screw extruder or the like, cooling the melt-kneaded product, thereafter roughly pulverizing with a hammer-mill or the like, further, finely pulverizing with a fine pulverizer utilizing jet stream or a mechanical pulverizer, and classifying the pulverized product to a given particle size with a classifier utilizing gyratory stream or a classifier utilizing a Coanda effect.

The toner surface may be subjected to the surface treatment with an external additive. The external additive includes fine inorganic particles made of silica, alumina, titania, zirconia, tin oxide, zinc oxide or the like. Among them, silica having a small specific gravity is preferable from the viewpoint of prevention of embedment of the external additive.

The silica is preferably a hydrophobic silica which has been hydrophobically treated, from the viewpoint of environmental stability. The method of hydrophobic treatment of the silica is not particularly limited. The agent for hydrophobic treatment includes hexamethyldisilazane (HMDS), dimethyldichlorosilane, silicone oil, methyltriethoxysilane, and the like. Among them, hexamethyldisilazane is preferable. It is preferable that the amount of the agent for hydrophobic treatment is from 1 to 7 $mg/m^2$ per surface area of the fine inorganic particles.

The external additive has an average particle size of preferably from 3 to 300 nm, and more preferably from 5 to 100 nm, from the viewpoint of chargeability and prevention of damage to the photoconductor.

The external additive is contained in an amount of preferably from 0.01 to 10 parts by weight, and more preferably from 0.1 to 5 parts by weight, based on 100 parts by weight of the toner before the treatment with the external additive.

The step of the surface treatment with the external additive is preferably carried out according to a dry mixing method using a high-speed mixer such as a Henschel mixer or a Super mixer, a V blender, or the like. The external additive may be previously mixed and added to a high-speed mixer or V blender, or may be separately added to a high-speed mixer or V blender.

The color toner has a volume-median particle size ($D_{50}$) of preferably from 3 to 12 μm, and more preferably from 5 to 10 μm.

Color and a mixing ratio of the color toners used in the method of the present invention are determined depending on a desired color of the mixed color toner.

The mixed color toner of the present invention can be either directly used as a toner for monocomponent development in a monocomponent developing method, or used as a toner for two-component development in which the toner mixed with a carrier is used in a two-component developing method. The mixed color toner of the present invention can be suitably used as a toner for two-component development in that the mixed color toner of the present invention is adaptable for high-speed printing. Therefore, the present invention further provides a two-component developer containing the mixed color toner of the present invention and a carrier.

In the present invention, as a carrier, it is preferable to use a carrier having a low saturated magnetization, which forms a soft magnetic brush, from the viewpoint of the properties of fixed images. The carrier has a saturated magnetization of preferably from 40 to 100 $Am^2/kg$, and more preferably from 50 to 90 $Am^2/kg$. A saturated magnetization is preferably 100 $Am^2/kg$ or less from the viewpoint of adjusting hardness of the magnetic brush and retaining tone reproductivity, and is preferably 40 $Am^2/kg$ or more from the viewpoint of preventing carrier adhesion and toner scattering. A saturated magnetization of the carrier is determined according to the method described in Examples set forth below.

As a core material for the carrier, a core material made from any known materials can be used without particular limitation. The core material includes, for example, ferromagnetic metals such as iron, cobalt and nickel; alloys and compounds such as magnetite, hematite, ferrite, copper-zinc-magnesium-based ferrite, manganese-based ferrite, and magnesium-based ferrite; glass beads; and the like. Among them, iron powder, magnetite, ferrite, copper-zinc-magnesium-based ferrite, manganese-based ferrite, and magnesium-based ferrite are preferable from the viewpoint of chargeability, and ferrite, copper-zinc-magnesium-based ferrite, manganese-based ferrite, and magnesium-based ferrite are more preferable from the viewpoint of image quality.

The surface of the carrier is preferably coated with a resin from the viewpoint of reducing staining on the carrier. The resin for coating the surface of the carrier varies depending upon the materials for the toner. The resin includes, for example, a fluororesin such as polytetrafluoroethylene, a monochlorotrifluoroethylene polymer, poly(vinylidene fluoride); a silicone resin such as polydimethylsiloxane; a polyester; a styrenic resin; an acrylic resin; polyamide; polyvinyl butyral; an aminoacrylate resin; and the like. These resins can be used alone or in admixture of two or more kinds. When the toner is negatively chargeable, a silicone resin is preferable from the viewpoint of chargeability and the surface energy. The method of coating the core material by the resin includes, for example, a method including the steps of dissolving or suspending a coating material such as a resin in a solvent, and applying the resulting solution or suspension to the core material to allow the resin to adhere thereto; a method including the step of simply mixing the core material with the resin in powdery forms; and the like.

In the two-component developer of the present invention obtainable by mixing the toner and the carrier, a weight ratio of the toner to the carrier, i.e., toner/carrier, is preferably from 1/99 to 10/90, and more preferably from 5/95 to 7/93.

Further, the mixed color toner and the two-component developer containing the toner of the present invention are not fluctuated in the development efficiency even in a non-contact development system since the zeta potential distributions of the combined color toners are conformable. Therefore, the mixed color toner and the two-component developer containing the toner of the present invention are used for a method of forming fixed images including the step of developing the image according to a non-contact development system, whereby the effects of the present invention are more remarkably exhibited.

According to the method of forming fixed images of the present invention, fixed images are formed through known steps except that the method has a feature in the developing step where an electrostatic latent image is developed according to a non-contact development system. The steps in the method of forming fixed images include, other than the developing step, for example, the steps of forming an electrostatic latent image on the surface of a photoconductor (charging and exposing step); transferring the developed toner image to an image-bearing material such as paper (transferring step); fixing the translated toner image (fixing step); removing the toner remaining on a developing member such as a photoconductive drum (cleaning step); and the like.

In addition, the mixed color toner of the present invention can be also suitably used for method of forming fixed images, comprising the step of using a high-speed image-forming apparatus with a linear speed of preferably 500 mm/sec or more, and more preferably from 700 to 3000 mm/sec. Here, the linear speed refers to a processing speed of an image-forming apparatus, and is determined by sheet feeding speed in the fixing portion.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Glass Transition Temperature of Resin]

The glass transition temperature refers to a temperature of an intersection of the extension of the baseline of equal to or lower than the temperature of the endothermic highest peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Value of Resin]

The acid value is determined by a method according to JIS K0070 except that only the determination solvent was changed from a mixed solvent of ethanol and ether as prescribed according to JIS K0070 to a mixed solvent of acetone and toluene (volume ratio of acetone:toluene=1:1).

[Volume-Median Particle Size ($D_{50}$) of Mother Toner Particles and Toner]

Measuring Apparatus Coulter Multisizer II (commercially available from Beckman Coulter K.K.)

Aperture Diameter: 100 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: "EMULGEN 109P" (commercially available from Kao Corporation, polyoxyethylene lauryl ether, HLB: 13.6) is dissolved in the above electrolytic solution so as to have a concentration of 5% by weight, to give a dispersion. Dispersion Conditions Ten milligrams of a test sample is added to 5 mL of the above dispersion, and the resulting mixture is dispersed in an ultrasonic disperser for 1 minute. Thereafter, 25 mL of the electrolytic solution is added to the dispersion, and the resulting mixture is dispersed in the ultrasonic disperser for another 1 minute, to give a sample dispersion.

Measurement Conditions: The above sample dispersion is adjusted so as to have a concentration at which the particle sizes of 30,000 particles can be determined in 20 seconds by adding the above sample dispersion to 100 mL of the above electrolytic solution. Thereafter, the particle sizes of 30,000 particles are determined to obtain a volume-median particle size ($D_{50}$) from the particle size distribution.

[Average Particle Size of External Additive]

The average particle size of primary particles is calculated according to the following formula:

$$\text{Average Particle Size(nm)}=6/(\rho\times\text{Specific Surface Area}(m^2/g))\times 1000,$$

wherein ρ is a true specific gravity of the external additive. For example, the true specific gravity of silica is 2.2. The specific surface area is a BET specific surface area obtained by nitrogen absorption method. In the case of hydrophobically treated external additive, a specific surface area of the original external additive before hydrophobic treatment is used. Supposing that the external additive is a sphere having a particle size of R, the above formula can be obtained by the following formulae:

$$BET\ \text{Specific Surface Area}=S\times(1/m)$$

$$m\ (\text{Weight of Particles})=4/3\times\pi\times(R/2)^3\times\text{True Specific Gravity}$$

$$S\ (\text{Surface Area})=4\pi(R/2)^2.$$

[Saturated Magnetization of Carrier]

(1) A carrier is filled in a plastic case with a lid with tapping, the case having an outer diameter of 7 mm (an inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturated magnetization is determined by applying a magnetic field of 79.6 kA/m, with vibrating the plastic case using the vibration function. The value obtained is calculated as the saturated magnetization per unit mass, taking into consideration the mass of the filled carrier.

Production Example 1 for Resin

A 5 liter-four-necked flask equipped with a nitrogen inlet tube, a dehydration tube, a stirrer, and a thermocouple was charged with 1,040 g of polyoxypropylene(2.2)-2,2-bis(4-hydroxyphenyl)propane, 10 g of polyoxyethylene(2.0)-2,2-bis(4-hydroxyphenyl)propane, 199 g of terephthalic acid, and 4 g of dibutyltin oxide. The ingredients in the flask were reacted at an atmospheric pressure at 230° C. for 5 hours. Thereafter, the reaction mixture was reacted at 8.3 kPa for 2 hours. The reaction solution was cooled to 210° C., and 209 g of fumaric acid and 1 g of hydroquinone were added thereto. The ingredients were reacted for 5 hours, and thereafter further reacted at 8.3 kPa until the desired softening point was reached, to give a resin A (polyester). The resulting resin A had a softening point of 109.5° C., a glass transition temperature of 64.4° C., and an acid value of 21.3 mgKOH/g.

Production Examples for Color Toners

Magenta Toners

One-hundred parts by weight of the resin A, 5 parts by weight of a colorant "Super Magenta R" (commercially available from Dainippon Ink and Chemicals Incorporated), 2 parts by weight of a polypropylene wax "NP-105" (commercially available from MITSUI CHEMICALS, INC.), and charge control agents as shown in Table 1, were pre-mixed with a 20 liter Henschel mixer at 1200 r/min for a time period as shown in Table 1. Thereafter, the mixture was melt-kneaded with a twin-screw extruder "PCM30" (commercially available from IKEGAI Corporation) under the conditions as shown in Table 1. The melt-kneaded product was cooled, and thereafter roughly pulverized to a size of 1 mm or so using a hammer-mill. The resulting roughly pulverized product was finely pulverized with an air-jet type pulverizer, and thereafter the pulverized product was classified, to give a negatively chargeable toner consisting of toner particles having a volume-median particle size ($D_{50}$) of 8.5 μm as shown in Table 1.

One-hundred parts by weight of each of the resulting toners were mixed with 0.9 parts by weight of a hydrophobic silica "R972" (commercially available from Nippon Aerosil, average particle size of 16 nm) with a Henschel mixer for 3 minutes to externally add the hydrophobic silica to the toner surface, to give each of magenta toners (toners M1 to M3).

<Cyan Toners>

The same procedures as magenta toners were carried out except that 3.5 parts by weight of "CYANINE BLUE KRO" (commercially available from SANYO COLOR WORKS, LTD.) were used as a colorant, to give each of cyan toners (toners C1 to C3).

<Yellow Toners>

The same procedures as magenta toners were carried out except that 5 parts by weight of "PV Fast Yellow II9G VP2430" (commercially available from Clariant (Japan) K.K., C.I. pigment yellow 214) were used as a colorant, to give each of yellow toners (toners Y1 to Y3).

TABLE 1

| | Charge Control Agent [1] | | Pre-mixing Time | Melt-kneading Conditions [2] | | | | | |
|---|---|---|---|---|---|---|---|---|---|
| | | | | C1 | C2 | C3 or later | Die | Rotational Speed | Feeding Amount |
| | Negative | Positive | (Second) | (° C.) | (° C.) | (° C.) | (° C.) | (r/min) | (kg/h) |
| Toner M1 | 3.0 | 0.5 | 30 | 30 | 60 | 80 | 90 | 240 | 10 |
| Toner M2 | 3.0 | 0.5 | 30 | 30 | 60 | 80 | 90 | 180 | 10 |
| Toner M3 | 3.0 | 0.5 | 120 | 30 | 60 | 80 | 90 | 180 | 10 |
| Toner C1 | 3.2 | 0.6 | 120 | 30 | 60 | 80 | 90 | 240 | 10 |
| Toner C2 | 3.2 | 0.6 | 120 | 30 | 60 | 80 | 90 | 180 | 10 |
| Toner C3 | 3.2 | 0.6 | 120 | 30 | 50 | 70 | 90 | 180 | 10 |
| Toner Y1 | 2.9 | 0.7 | 120 | 30 | 60 | 80 | 90 | 180 | 10 |
| Toner Y2 | 2.9 | 0.7 | 120 | 30 | 60 | 80 | 90 | 240 | 10 |
| Toner Y3 | 2.9 | 0.7 | 30 | 30 | 60 | 80 | 90 | 180 | 10 |

[1] Negative: a negatively chargeable charge control agent "BONTRON E-81" (commercially available from Orient Chemical Co., Ltd, a chromium complex of a salicylic acid compound) Positive: a positively chargeable charge control agent "COPY CHARGE PSY" (commercially available from Clariant (Japan) K.K., a quaternary ammonium salt of a carboxylic acid)

[2] C1, C2, and C3 refer to cylinders from the raw material feeding side of a twin-screw extruder, and are used to describe a set temperature of each of the cylinders.

Zeta potentials and triboelectric charges of each of the resulting color toners were determined according to the following method. Based on the determined zeta potentials, a histogram showing the distributions of the zeta potentials with intervals of 5 mV and triboelectric charges are shown in Table 2. Here, triboelectric charges of the toners are preferably in the range of from −12 to −17 μC/g, from the viewpoint of development property.

[Determination of Zeta Potentials]

The toner is added to an EMULGEN 109P solution (5% by weight) diluted with ion-exchanged water and dispersed by ultrasonic wave for 5 minutes. Further, the resulting dispersion is replenished with ion-exchanged water so as to have a toner concentration of 0.05% by weight before determination, and injected into a cell for determination (made of aqueous fluororesin (light path section is made of glass), cell thickness of 0.75 mm (found value in the cell), cell width of 10 mm) to carry out the determination within 3 minutes. A zeta potential analyzer "zeecom (ZC-2000)" commercially available from Microtec Co., Ltd. is used for determination. A determination method of the zeta potential distribution is carried out according to the determination procedures of "zeecom (ZC-2000)." "Zeecom (ZC-2000)" is set at a migration voltage of 20 V, a solution temperature of 19.0° C., a solution pH of 4.0, a solution viscosity of 0.010271 poise, a solution dielectric constant of 80.47, a distance between electrodes of 90 mm, toner particles to be tracked of 100 particles, a tracking time of 1 toner particle of 5 seconds, and uses halogen transmitted light as a light source, to determine zeta potentials of each of the toner particles. Here, the zeta potential of each of the toner particles is calculated according to the following formula:

Zeta Potential=(4π×Solution Viscosity/Solution Dielectric Constant)×(Particle Speed/(Migration Voltage/Distance Between Electrodes)×300×300×1000

The zeta potentials of 100 particles of the toner particles are determined.

[Determination of Triboelectric Charges]

A 50 ml polyethylene bottle is charged with 0.6 g of the toner and 19.4 g of a silicone-coated ferrite carrier (commercially available from Kanto Denka Kogyo Co., Ltd., average particle size of 90 μm), and mixed with a ball-mill at 250 r/min, to determine triboelectric charges of the toner using a q/m meter (commercially available from Epping GmbH). A specified amount of the toner is supplied in a cell provided in the q/m meter and only the toner is aspirated for 90 seconds through a sieve having a sieve opening of 32 μm (made of stainless steel, twilled, wire diameter of 0.0035 mm). The voltage change generated on the carrier at this time is monitored, and the value of [Total Electric Charges After 90 Seconds (μC)/Amount of Toner Aspirated (g)] is defined as the triboelectric charges (μC/g).

TABLE 2

| Absolute Value of Zeta Potential[1)] | Toner | | | | | | | | |
|---|---|---|---|---|---|---|---|---|---|
| (ζ, mV) | M1 | M2 | M3 | C1 | C2 | C3 | Y1 | Y2 | Y3 |
| 95 | 0 | 0 | 0 | 0 | 0 | 0 | 0 | 0 | 0 |
| 90 | 0 | 0 | 0 | 0 | 0 | 0 | 0 | 0 | 0 |
| 85 | 2 | 0 | 0 | 0 | 1 | 0 | 0 | 0 | 0 |
| 80 | 3 | 0 | 0 | 0 | 1 | 0 | 0 | 0 | 0 |
| 75 | 24 | 0 | 0 | 0 | 14 | 0 | 1 | 0 | 0 |
| 70 | 13 | 0 | 0 | 1 | 17 | 0 | 19 | 0 | 1 |
| 65 | 9 | 0 | 0 | 1 | 14 | 5 | 22 | 0 | 5 |
| 60 | 12 | 1 | 1 | 6 | 19 | 19 | 24 | 0 | 14 |
| 55 | 16 | 2 | 20 | 14 | 11 | 52 | 18 | 0 | 25 |
| 50 | 9 | 6 | 15 | 4 | 10 | 22 | 9 | 2 | 20 |
| 45 | 5 | 11 | 24 | 5 | 6 | 2 | 5 | 2 | 15 |
| 40 | 5 | 16 | 18 | 10 | 4 | 0 | 2 | 14 | 16 |
| 35 | 1 | 12 | 16 | 11 | 3 | 0 | 0 | 20 | 3 |
| 30 | 1 | 8 | 6 | 7 | 0 | 0 | 0 | 22 | 1 |
| 25 | 0 | 9 | 0 | 9 | 0 | 0 | 0 | 19 | 0 |
| 20 | 0 | 6 | 0 | 10 | 0 | 0 | 0 | 18 | 0 |
| 15 | 0 | 16 | 0 | 9 | 0 | 0 | 0 | 2 | 0 |
| 10 | 0 | 10 | 0 | 6 | 0 | 0 | 0 | 1 | 0 |
| 5 | 0 | 3 | 0 | 7 | 0 | 0 | 0 | 0 | 0 |
| Percentages of $15 < \zeta \leqq 80$[2)] | 98 | 71 | 100 | 78 | 99 | 100 | 100 | 97 | 100 |
| Triboelectric Charges (μC/g) | −15 | −13 | −13 | −13 | −14 | −14 | −14 | −13 | −14 |

[1)]All the zeta potentials of the toner particles constituting each of the toners are the negative values, a zone stated as "X" refers to a zone of $X-5 < \zeta \leqq X$ (example: a zone of $50 \rightarrow 45 < \zeta \leqq 50$).

[2)]Percentages of the toner particles which the zeta potentials ζ are within the range of $15\ mV < \zeta \leqq 80\ mV$ by the absolute value (% by number)

Examples 1 to 11 and Comparative Examples 1 to 7

One kilogram each of the color toners in a combination as shown in Table 4 were supplied in a Henschel mixer and mixed for 30 seconds, to give a mixed color toner. Based on a histogram of each of the color toners, an overlapping ratio of the zeta potentials in the combined toner was calculated. The result is shown in Table 4. For example, in the case of Comparative Example 1 and Example 1, the total number of the toner particles in columns framed by double lines in Table 3, i.e., 130 particles in Comparative Example 1, and 199 particles in Example 1, the total number of the toner particles of which segments of the zeta potentials correspond among the color toners used. The overlapping ratio is defined as follows:

Comparative Example 1: 130/the total number of the toner particles determined (200)×100=65% by number Example 1: 199/the total number of the toner particles determined (200)×100=99.5% by number

TABLE 3

| Absolute Value of Zeta Potential (ζ, mV) | Comparative Example 1 | | Example 1 | |
|---|---|---|---|---|
| | Toner M1 | Toner C1 | Toner M1 | Toner C1 |
| 95 | 0 | 0 | 0 | 0 |
| 90 | 0 | 0 | 0 | 0 |
| 85 | 2 | 0 | 2 | 1 |
| 80 | 3 | 0 | 3 | 1 |
| 75 | 24 | 0 | 24 | 14 |
| 70 | 13 | 1 | 13 | 17 |
| 65 | 9 | 1 | 9 | 14 |
| 60 | 12 | 6 | 12 | 19 |
| 55 | 16 | 14 | 16 | 11 |
| 50 | 9 | 4 | 9 | 10 |
| 45 | 5 | 5 | 5 | 6 |
| 40 | 5 | 10 | 5 | 4 |
| 35 | 1 | 11 | 1 | 3 |
| 30 | 1 | 7 | 1 | 0 |
| 25 | 0 | 9 | 0 | 0 |
| 20 | 0 | 10 | 0 | 0 |
| 15 | 0 | 9 | 0 | 0 |
| 10 | 0 | 6 | 0 | 0 |
| 5 | 0 | 7 | 0 | 0 |

Test Example 1

A developing unit of a non-contact developing type image-forming apparatus "Vario Stream 9000" commercially available from Oce Printing Systems was modified so that the developing unit by itself could agitate a developer at the same processing speed as inside a printer. Five kilograms of a ferrite carrier (average particle size: 60 μm, saturated magnetization: 68 $\mu m^2/kg$) were supplied in the modified "Vario Stream 9000," and a mixed color toner was supplied so as to have a toner concentration of 6% by weight. Thereafter, the mixture was agitated for 10 minutes, and then agitated at a BW printing ratio of 1% with a linear speed of 1000 mm/sec for 5 hours. Thereafter, a toner on a jump roller was sampled, and hues of the mixed color toner before the supply to the ferrite carrier and the mixed color after the agitation for 5 hours were determined with a "GRETAG SPM50" (commercially available from Gretag Macbeth AG), and a degree of the change of hue was defined as Δh (Before Supply—After Supply). Tolerance limit of Δh is 10 or less.

TABLE 4

| | Combination of Toners | | Overlapping Ratio (%) | Δh |
|---|---|---|---|---|
| Comp Ex. 1 | M1 | C1 | 65 | 16 |
| Ex. 1 | M1 | C2 | 99.5 | 5> |
| Ex. 2 | M1 | C3 | 75.5 | 8 |
| Ex. 3 | M1 | Y1 | 96.5 | 5> |
| Comp Ex. 2 | M1 | Y2 | 40.5 | 18 |
| Ex. 4 | M1 | Y3 | 85.5 | 7 |
| Ex. 5 | M2 | C1 | 99 | 5> |
| Comp Ex. 3 | M2 | C2 | 50.5 | 17 |
| Comp Ex. 4 | M2 | C3 | 57.5 | 18 |
| Comp Ex. 5 | M2 | Y1 | 47 | 19 |
| Ex. 6 | M2 | Y2 | 97 | 5> |
| Ex. 7 | M2 | Y3 | 75 | 8 |
| Ex. 8 | M3 | C1 | 78.5 | 6 |
| Ex. 9 | M3 | C2 | 73.5 | 7 |
| Ex. 10 | M3 | C3 | 77.5 | 7 |
| Comp Ex. 6 | M3 | Y1 | 68 | 12 |
| Comp Ex. 7 | M3 | Y2 | 69.5 | 12 |
| Ex. 11 | M3 | Y3 | 97 | 5> |

Note)
"5>" in Δh shows that Δh is less than 5.

It can be seen that, the toners of Examples 1 to 11 obtained by mixing the color toners of which the overlapping ratio of the zeta potentials is high, has a smaller color change of the fixed images in continuous printing, and can maintain a certain color, as compared to Comparative Examples 1 to 7 obtained by mixing the color toners of which the overlapping ratio of zeta potentials is low. In addition, it can be seen from, for example, contrasts of Comparative Example 5 with Example 7, and Comparative Example 6 with Example 11, even if relations of the triboelectric charges are the same, the values of Δh are completely different, and the effects exercised by the overlapping ratio on the change of hue is not dependent on the triboelectric charges.

The mixed color toner obtainable according to the method of the present invention are used for, for example, developing a latent image or the like formed in electrophotography, electrostatic recording method, electrostatic printing method, or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A process for preparing a mixed color toner obtained by mixing two or more kinds of color toners of which each color is different, comprising:

(1) determining a zeta potential distribution of toner particles of each of the color toners;

(2) selecting a combination of the color toners so that an overlapping ratio of the zeta potential distribution is 70% or more; and (3) dry mixing the color toners in the combination selected in (2).

2. The process according to claim 1, wherein absolute values of zeta potentials of 70% by number or more of the toner particles of each of the color toners are more than 15 mV and 80 mV or less.

3. The process according to claim 1, wherein each of the color toners comprise polyester as a resin binder.

4. The process according to claim 3, wherein each of the color toners comprise a charge control agent having a carboxyl group.

5. The process according to claim 3, wherein each of the color toners comprise a positively charge control agent having a carboxyl group and a negatively charge control agent having a carboxyl group.

* * * * *